US005444516A

United States Patent [19]

Michlin et al.

[11] Patent Number: 5,444,516

[45] Date of Patent: Aug. 22, 1995

[54] PHOTORECEPTOR DRUM AXLE IMPROVEMENT

[75] Inventors: Steven B. Michlin, 5310 Bentley Suite 105, West Bloomfield, Mich. 48322; Dick D. Irwin, Grand Rapids, Mich.

[73] Assignee: Steven Bruce Michlin, West Bloomfield, Mich.

[21] Appl. No.: 234,236

[22] Filed: Apr. 28, 1994

[51] Int. Cl.[6] ..... G03G 21/00; G03G 21/16

[52] U.S. Cl. ..... 355/200; 355/211

[58] Field of Search ..... 355/200, 211, 212, 213

[56] References Cited

U.S. PATENT DOCUMENTS

| | | | |
|---|---|---|---|
| 4,530,588 | 7/1985 | Kimura et al. | 355/211 |
| 4,575,221 | 3/1986 | Onoda et al. | 355/200 |
| 4,839,690 | 6/1989 | Onoda et al. | 355/211 |
| 4,951,599 | 8/1990 | Damji | 355/200 X |
| 4,975,744 | 12/1990 | Ebata et al. | 355/211 |
| 5,019,861 | 5/1991 | Surti | 355/200 |
| 5,132,728 | 7/1992 | Suzaki et al. | 355/200 |
| 5,142,322 | 8/1992 | Surti | 355/200 |

*Primary Examiner*—Fred L. Braun

[57] ABSTRACT

A sleeve for the shaft section of a plastic drum axle used in toner cartridges for printing, copy and facsimile machines to rotatively support the photoreceptor drum. The sleeve is made of strong plastic or metal and is sized to snugly fit around the shaft section. Glue may be used to further secure the sleeve to the shaft section. The sleeve is slid onto the drum axle shaft section and abuts against the drum axle attach section. The sleeve has a length and an outside diameter which allow the sleeve to snugly fit in the gear piece of the photoreceptor drum, eliminating the clearance between the shaft section and gear piece passage. In this way the gear piece and photoreceptor drum are rotatively supported on the drum axle along nearly the entire length of the shaft section, preventing the photoreceptor drum from wobbling during operation and rotation.

15 Claims, 1 Drawing Sheet

FIG - 1
PRIOR ART
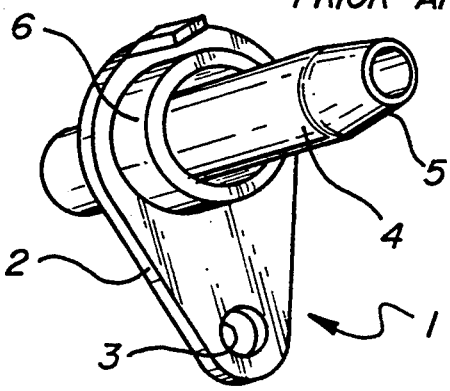
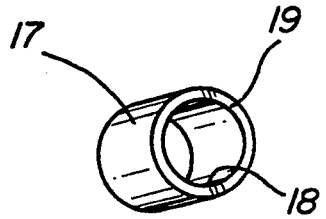
FIG - 3
FIG - 2
PRIOR ART
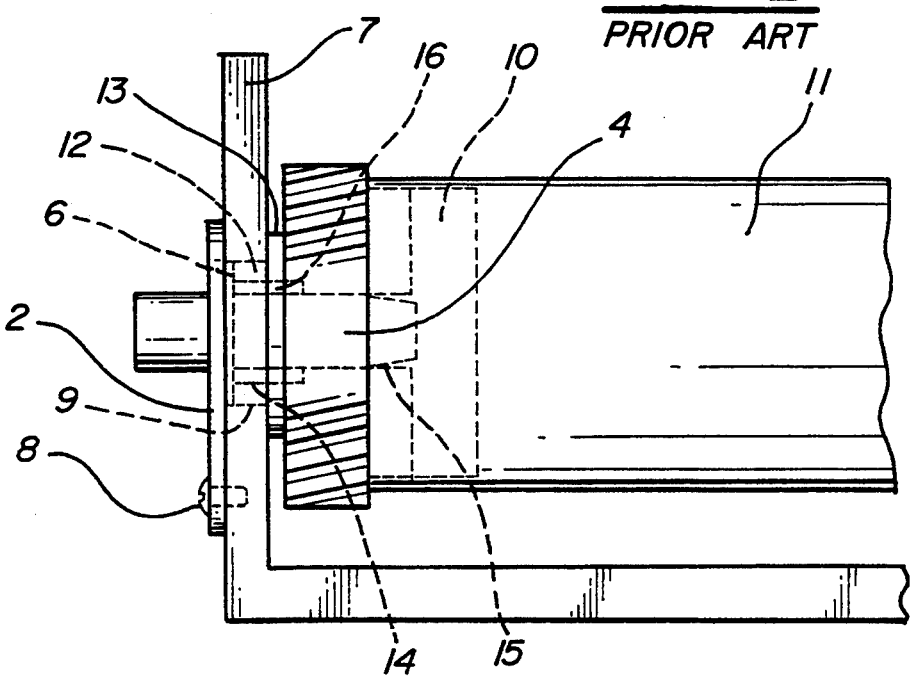
FIG - 4
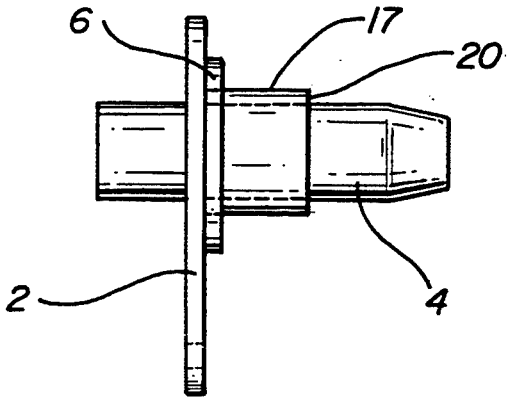

PHOTORECEPTOR DRUM AXLE IMPROVEMENT

BACKGROUND OF THE INVENTION

This invention relates to solving problems on photoreceptor drum axles used in Xerography and more specifically in the toner cartridge remanufacturing industry. This includes copiers, laser printers and facsimile machines which will be referred to throughout this text as imaging machines. However, it should be noted that the scope of this invention is not limited to imaging machines that use toner cartridges but includes all dry toner copiers, laser printers and facsimile machines.

CANON has designed an all-in-one cartridge as seen in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1994 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles. One good example is the drum axle used in imaging machines.

A typical cartridge uses a photoreceptor drum and has two drum axles, one at each end of the drum. In the normal case one of the two ends has a drum axle that also functions as an electrical contact for grounding the photoreceptor. The other end uses a drum axle that is simply in place for mechanical purposes without electrical application. It is this nonelectrical drum axle that is improved in this invention. The SX cartridge that was discussed has a specific problem that is not discernable without careful study. There are literally millions of these SX cartridges in the field. The device of this invention was designed around the defect of this SX cartridge so the cartridge will last longer. Rather than recommend a different printer (not SX) to customers, applicants have made a design that can improve these millions of defective cartridges reinforcing existing components with this invention.

The problem with the nonconductive drum axle is that the new ones are made of a plastic that is not wear resistant. This is interesting because the original drum axle was made of all steel. Eventually, the all metal drum axle was duplicated in plastic. The plastic versions are the majority of drum axles in the field at this time. However, the plastic axles become so worn that it can be seen by visual inspection with the naked eye.

The drum axle has an attach section and a shaft section. It is the shaft section that wears. When the shaft portion wears, its outside diameter decreases. It is this outside diameter that keeps the drum aligned with respect to its rotational axis. However, after the wear decreases this outside diameter, the drum is free to wobble. It wobbles, and will cause various photoreceptor drum operation defects. One defect that is visible on the output page is a light copy printed on the plastic drum axle side. As the problem gets worse with increased wear, eventually, in the most extreme case, the entire output page can be light or a completely white page can even be printed. The applicant had to do extensive research and development to fully understand the cause of the problem. Once the cause of the problem was discovered, a design was made to fix the problem and thus improve the drum axle.

SUMMARY OF THE INVENTION

Accordingly, it is an object of this invention to increase the life of a plastic drum axle used to support a photoreceptor drum in a toner cartridge for printing, copy and facsimile machines.

It is another object of this invention to increase the length of the shaft section of the drum axle which rotatively supports the photoreceptor drum.

Still another object of this invention is to provide an improved drum axle which better fits into the gear piece of the photoreceptor drum and smooths out the rotation of the drum.

A further object of this invention is to prevent poor quality images on the output paper of imaging machines and prevent excessive component wear caused by wobbly photoreceptor drum rotation.

In carrying out this invention in the illustrative embodiment thereof, a strong plastic or metal sleeve approximately one-quarter of an inch in length is placed around the shaft section of a drum axle adjacent the attach section. The outside diameter of the sleeve is sized to fit within part of the passage through the gear piece on the photoreceptor drum. Instead of the shaft section rotatively supporting the drum for just a small length of the shaft section, the sleeve enables nearly the entire length of the shaft section to rotatively support the drum. This smooths out the rotation of the drum, reduces wear on the drum axle (extending the life of the drum axle), and maintains the quality of the image on the output paper.

BRIEF DESCRIPTION OF THE DRAWINGS

This invention, together with other objects, features, aspects, and advantages thereof, will be more clearly understood from the following description, considered in conjunction with the accompanying drawings.

FIG. 1 shows a slightly enlarged conventional plastic drum axle for a photoreceptor drum.

FIG. 2 is a broad illustration of how the conventional drum axle is used in a toner cartridge assembly.

FIG. 3 shows the sleeve, slightly enlarged, of this invention.

FIG. 4 illustrates the location on the drum axle where the sleeve is used.

COMPLETE DESCRIPTION OF THE PREFERRED EMBODIMENT

FIG. 1 shows a conventional plastic photoreceptor drum axle 1. The drum axle 1 has an attach section 2 which includes a small screw hole 3. A shaft section 4 has a slightly tapered end portion 5. The shaft section 4 extends into a fitting section 6 of the drum axle 1 at the end of the shaft section 4 opposite to the tapered end portion 5.

The drum axle 1 is used as broadly illustrated in FIG. 2. The attach section 2 is secured to the toner cartridge wall 7 by a screw 8 extending through the small screw hole 3. The fitting section 6 of the drum axle 1 fits into a bore 9 through the toner cartridge wall 7. The shaft section 4 of the drum axle 1 is received in the gear piece 10 mounted on the photoreceptor drum 11. The gear piece 10 is fixed to the drum 11 such that when the gear piece 10 is driven by the imaging machine during operation of the toner cartridge, the drum 11 rotates with the gear piece 10 around the shaft section 4 of the drum axle 1.

Some gear teeth have been left-off the drawing so the inner part of the gear piece 10 and adjacent areas may be more clearly shown. The gear piece 10 includes a cylindrical extension having two parts 12 and 13. The first part 12 fits into the bore 9 of the toner cartridge wall 7. The second part 13 of the cylindrical extension has a larger diameter than the first part 12 and spaces the gear portion of the gear piece 10 from the toner cartridge wall 7.

There is a passage extending through the gear piece 10. The passage has a first segment 14 and a second segment 15 having a smaller diameter than the first segment 14. The second segment 15 of the passage is approximately the same diameter as the outer diameter of the shaft section 4 of the drum axle 1. The slightly tapered end portion 5 of the shaft section 4 of the drum axle 1 allows for easy insertion of the shaft section 4 into the second segment 15 of the passage through the gear piece 10. The fit is snug but enables easy rotation of the gear piece 10, and therefore the photoreceptor drum 11, around the shaft section 4 of the drum axle 1. But a significant length of the shaft section 4 does not contact the passage wall in the first segment 14 of the passage through the gear piece 10 because of the clearance 16 between the larger diameter first segment 14 and the shaft section 4.

Wear of the drum axle 1 takes place on the shaft section 4 where it contacts and rubs against the wall of the second segment 15 of the passage through the gear piece 10. This wear eventually allows the photoreceptor drum 11 to wobble during its operation and rotation, causing light print on the side of the output paper adjacent the plastic drum axle 1 side of the drum 11. At some point, no image would be printed. The drum axle at the opposite side of the photoreceptor drum 11 is usually metal since it also functions as an electrical contact for grounding the drum 11. The drum axle wear and output image problems do not occur as readily at that location. The invention of this application solves the wear problem on the plastic drum axle 1 and maintains the quality of the image without forcing replacement or redesign of the plastic drum axle 1.

The sleeve of this invention is shown in FIG. 3, in slightly enlarged form. The sleeve 17 is approximately one-quarter of an inch long, a length corresponding to the length of the first segment 14 of the passage through the gear piece 10 plus the distance the shaft section 4 extends into the fitting section 6 of the drum axle 1. The sleeve 17 is made of either strong plastic or metal. The metal could be steel or copper. It has been found that metal alloy 12L14 Steel works well.

The sleeve 17 fits around the shaft section 4 of the drum axle 1 as illustrated in FIG. 4. The sleeve 17 extends into the fitting section 6 and abuts against the attach section 2, so the sleeve 17 is precisely located on the shaft section 4 quickly and easily. The inner diameter 18 of the sleeve 17 may be glued or otherwise adhered to the outer diameter of the shaft section 4. The outside diameter 19 of the sleeve 17 is approximately equal to the diameter of the first segment 14 of the passage through the gear piece 10, but does not fit so tightly within the first segment 14 that the sleeve 17 interferes with the rotation of the gear piece 10 and photoreceptor drum 11. The inner diameter 18 of the sleeve 17 is approximately five-sixteenths of an inch and the outside diameter 19 of the sleeve 17 is approximately three-eighths of an inch.

When the drum axle 1 is inserted in the gear piece 10, the end 20 of the sleeve 17 abuts against the rim formed where the first segment 14 of the passage through the gear piece 10 meets the smaller diameter second segment 15. When the sleeve 17 is used on the drum axle 1, nearly the entire length of the shaft section 4 is used to support the gear piece 10 and photoreceptor drum 11. This lessens wear on the part of the shaft section 4 extending through the second segment 15 of the gear piece 10 and prevents the drum 11 from wobbling and causing the above noted image quality problems. By eliminating the clearance 16 between the shaft section 4 and the first segment 14 of the passage through the gear piece 10, the sleeve 17 keeps the photoreceptor drum 11 rotating smoothly and extends the life of the drum axle 1.

Thus, all components last longer with a drum 11 that rotates true. The drum 11, wiper blades, charge roller, and many components will last longer by preventing a drum wobble.

Please note that some cartridges such as the IIISi has a metal drum axle 1 on the nonconductive gear side. It has been found that after usage, the hole in the plastic gear can enlarge over three thousandths of an inch, causing a slight wobble. It has been found from extensive testing that IIISi gears wear very quickly. It is a known problem that plagues the industry that the IIISi photoreceptor drum wears out quickly, but nobody previously knew why. This three thousandths of an inch, however, explains this typical IIISi problem that nobody prior to applicant has solved. The IIISi problem occurs more easily also because the IIISi cartridge has double the speed of the SX cartridge at 17 pages per minute versus 8 pages per minute. Further explaining it, the IIISi cartridge has double the life cycle and a significantly greater duty of page rating per month. By drilling and/or reaming the hole of the gear in the IIISi photoreceptor drum, and placing in the sleeve 17 and in some cases gluing in the sleeve 17, for either full or partial length of the gear, the gear may be thus reinforced to prevent the wear that causes the wobble.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. An improvement for a plastic drum axle used to support a photoreceptor drum in a toner cartridge for printing, copy and facsimile machines, said drum axle including an attach section for securing said drum axle to said toner cartridge, a fitting section adjacent said attach section for fitting said drum axle into said toner cartridge, and a shaft section, said shaft section having a length with only a portion of said length used for rotatively supporting said drum, said improvement comprising a sleeve placed around said shaft section such that said sleeve extends into said fitting section and abuts against said attach section, whereby said sleeve may be precisely located on said shaft section and enables nearly the entire length of said shaft section to rotatively support said drum.

2. An improvement for a plastic drum axle as in claim 1 wherein said sleeve is made of strong plastic.

3. An improvement for a plastic drum axle as in claim 1 wherein said sleeve is made of metal.

4. An improvement for a plastic drum axle as in claim 3 wherein said metal is metal alloy 1241.

5. An improvement for a plastic drum axle as in claim 3 wherein said sleeve is approximately one-quarter of an inch in length.

6. An improvement for a plastic drum axle as in claim 5 wherein said sleeve has an outside diameter of approximately three-eigths of an inch.

7. An improvement for a plastic drum axle as in claim 6 wherein said sleeve has an inside diameter of approximately five-sixteenths of an inch.

8. An improvement for a plastic drum axle as in claim 1 wherein said sleeve is approximately one-quarter of an inch in length.

9. An improvement for a plastic drum axle as in claim 8 wherein said sleeve is glued to said shaft section.

10. An improvement for a plastic drum axle as in claim 8 wherein said sleeve has an outside diameter of approximately three-eighths of an inch.

11. An improvement for a plastic drum axle as in claim 10 wherein said sleeve has an inside diameter of approximately five-sixteenths of an inch.

12. An improvement for a plastic drum axle as in claim 11 wherein said sleeve is made of metal.

13. An improvement for a plastic drum axle as in claim 12 wherein said metal is metal alloy 1241.

14. An improvement for a plastic drum axle as in claim 11 wherein said sleeve is made of strong plastic.

15. An improvement for a plastic drum axle as in claim 1 wherein said sleeve is glued to said shaft section.

* * * * *